US011092154B2

(12) United States Patent
Choi et al.

(10) Patent No.: US 11,092,154 B2
(45) Date of Patent: Aug. 17, 2021

(54) SCROLL COMPRESSOR

(71) Applicant: LG ELECTRONICS INC., Seoul (KR)

(72) Inventors: Yoonsung Choi, Seoul (KR); Jinho Kim, Seoul (KR); Jaeha Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 270 days.

(21) Appl. No.: 16/290,099

(22) Filed: Mar. 1, 2019

(65) Prior Publication Data

US 2019/0271311 A1 Sep. 5, 2019

(30) Foreign Application Priority Data

Mar. 2, 2018 (KR) ..... 10-2018-0025302

(51) Int. Cl.

| | |
|---|---|
| ***F04C 18/02*** | (2006.01) |
| ***F04C 29/02*** | (2006.01) |
| ***F01C 21/02*** | (2006.01) |

(52) U.S. Cl.

CPC ..... *F04C 18/0215* (2013.01); *F01C 21/02* (2013.01); *F04C 29/02* (2013.01)

(58) Field of Classification Search

CPC ... F01C 21/02; F04C 18/0215; F04C 2240/52
See application file for complete search history.

(56) References Cited

U.S. PATENT DOCUMENTS 4,552,518 A * 11/1985 Utter ..... F04C 18/0215 418/55.6
9,897,143 B2 * 2/2018 Oh ..... F04C 18/0215

FOREIGN PATENT DOCUMENTS

| | | |
|---|---|---|
| EP | 0380439 | 8/1990 |
| EP | 0430853 | 6/1991 |
| FR | 2559847 | 8/1985 |
| JP | H05288167 | 11/1993 |
| JP | H10047267 | 2/1998 |
| JP | 2002188567 | 7/2002 |

(Continued)

OTHER PUBLICATIONS

Extended European Search Report in European Application No. 19159950.5, dated Mar. 3, 2019, 7 pages.

(Continued)

*Primary Examiner* — Mary Davis
(74) *Attorney, Agent, or Firm* — Fish & Richardson P.C.

(57) ABSTRACT

A scroll compressor includes a first scroll including a fixed wrap, a second scroll comprising an orbiting wrap, and a boss portion, a rotating shaft including an eccentric portion inserted into the boss portion of the second scroll to transfer a rotational force, a frame having a shaft hole, a first bearing provided between the shaft hole of the frame and an outer circumferential surface of the rotating shaft, and a second bearing provided between an inner circumferential surface of the boss portion and an outer circumferential surface of the eccentric portion of the rotating shaft, wherein a differential pressure space portion is formed between the first bearing and the second bearing in a radial direction, and has a radial cross section wider than a radial gap between an inner circumferential surface of the second bearing and the outer circumferential surface of the eccentric portion.

20 Claims, 6 Drawing Sheets

(56) References Cited

FOREIGN PATENT DOCUMENTS

| | | |
|---|---|---|
| JP | 2012122498 | 6/2012 |
| JP | 2013124622 | 6/2013 |
| JP | 6274280 | 2/2018 |
| KR | 1020050028216 | 3/2005 |
| WO | WO2009020106 | 2/2009 |

OTHER PUBLICATIONS

European Office Action in European Application No. 19159950.5, dated Sep. 11, 2019, 6 pages.

* cited by examiner

SCROLL COMPRESSOR

CROSS-REFERENCE TO RELATED APPLICATION

Pursuant to 35 U.S.C. § 119(a), this application claims the benefit of an earlier filing date of and the right of priority to Korean Application No. 10-2018-0025302, filed on Mar. 2, 2018, the contents of which are incorporated by reference herein in its entirety.

BACKGROUND OF THE DISCLOSURE

1. Field of the Disclosure

The present invention relates to a scroll compressor, and more particularly, to a scroll compressor in which a supporting bearing between a frame and a rotating shaft is provided to overlap a supporting bearing between the rotating shaft and an orbiting scroll.

2. Description of the Related Art

In a scroll compressor, an eccentric portion of a rotating shaft is inserted into a boss portion provided at an orbiting scroll, so that a rotational force of a driving motor is transmitted to a second scroll. In this case, the rotating shaft is inserted in a shaft hole of a main frame for supporting the orbiting scroll so as to be supported in a radial direction, and a fixed wrap provided on a fixed scroll and an orbiting wrap provided on an orbiting wrap are engaged with each other so as to form a pair of compression chambers.

Such a scroll compressor may behave unstably due to a centrifugal force generated while the orbiting scroll is performing an orbiting motion, a gas force generated while a refrigerant is compressed, and a gas repulsive force applied in a direction opposite to the centrifugal force.

Particularly, as disclosed in the Prior Art 1 (International Patent Publication No. WO2009/020106), in a structure in which a support point where a rotating shaft is radially supported by a main frame is axially spaced apart by a predetermined distance from an point of application whether the rotating shaft transfers a rotational force to the orbiting scroll, the rotating shaft is subjected to a large eccentric load and thus a bearing load is increased due to a gas force. Then, a frictional loss between the main frame and the rotating shaft or between the eccentric portion of the rotating shaft and the boss portion of the orbiting scroll is increased, and consequently compression efficiency of the compressor is lowered. In addition, this structure increases noise of the compressor, lowers reliability of the bearing, and increases an axial length of the main frame, which brings about an increase in an overall length of the compressor.

Thus, as disclosed in the Prior Art 2 (Japanese Patent Laid-Open Publication No. 2012-122498), a structure in which a boss coupling groove is formed at an upper end of a rotating shaft to be eccentric with respect to a center of the rotating shaft, and a boss portion of an orbiting scroll is inserted into the boss coupling groove has been introduced. That is, as a support point for supporting the rotating shaft and an point of application where a rotational force is transferred to the orbiting scroll are located at the same height or have a minimal gap therebetween, an eccentric load applied to the rotating shaft is reduced such that a frictional loss at a bearing supporting the rotating shaft and noise of the compressor can be reduced, reliability of the bearing can be enhanced and the compressor can be reduced in size.

However, in the related art scroll compressor such as the Prior Art 2, since the boss coupling groove of the rotating shaft 30 into which the boss portion 28 of the orbiting scroll is inserted is formed to be eccentric from the center of the rotating shaft, oil may not be smoothly supplied to a bearing 29 positioned between the boss portion of the orbiting scroll and the boss coupling groove of the rotating shaft during an operation of the compressor. As a result, the bearing is overheated and expanded, thereby increasing a frictional loss or abrasion. That is, the rotating shaft is provided therein with an oil passage to guide oil into the boss coupling groove. This oil lubricates between the bearing and the boss portion while passing through the bearing. However, since the rotating shaft, a second scroll and the main frame are brought into close contact with one another by the bearing, there is no empty space around the bearing. Accordingly, the oil introduced into the boss coupling groove cannot smoothly pass through the bearing. As a result, the oil is not fully brought into contact with the bearing and fails to smoothly cool the bearing. The bearing is overheated, thereby causing a friction loss with respect to the boss portion or abrasion.

SUMMARY OF THE DISCLOSURE

One aspect of the present invention is to provide a scroll compressor, capable of quickly cooling a bearing, which is disposed between a rotating shaft and an orbiting scroll and is located relatively inward, in case where a bearing supportingly disposed between a frame and the rotating shaft axially overlaps the bearing supportingly disposed between the rotating shaft and the orbiting scroll.

Another aspect of the present invention is to provide a scroll compressor, capable of quickly and smoothly supplying oil to a bearing between an orbiting scroll and a rotating shaft, in case where a bearing supportingly disposed between a frame and the rotating shaft axially overlaps the bearing supportingly disposed between the rotating shaft and the orbiting scroll.

Still another aspect of the present invention is to provide a scroll compressor, capable of quickly and smoothly supplying oil to a bearing between an orbiting scroll and a rotating shaft in a manner of greatly increasing a pressure difference between both sides of the bearing supportingly disposed between the orbiting scroll and the rotating shaft.

Still another aspect of the present invention is to provide a scroll compressor, capable of quickly and smoothly cooling a bearing disposed between an orbiting scroll and a rotating shaft by oil, which is sucked upward through an oil passage of the rotating shaft provided at an inner side of the bearing, in a manner of forming a differential pressure space at an outer side of the bearing.

To achieve the aspects and other advantages of the present invention, there is provided a scroll compressor, including a rotating shaft provided with an eccentric portion inserted into a boss portion of an orbiting scroll to transfer a rotational force, a bearing disposed between the boss portion and the eccentric portion, and a space portion formed in the rotating shaft and having an area larger than a gap between an inner circumferential surface of the bearing and an outer circumferential surface of the eccentric portion, wherein the space portion communicates with the gap.

Also, to achieve the aspects and other advantages of the present invention, there is provided a scroll compressor including a first bearing disposed between a frame and a rotating shaft to support the rotating shaft with respect to the frame in a radial direction, and a second bearing disposed between the rotating shaft and an orbiting scroll to support the rotating shaft with respect to the orbiting scroll in the radial direction, wherein the first bearing and the second bearing at least partially overlap each other in the radial direction, wherein a recess is formed at an upper end of the rotating shaft by a predetermined depth between the first bearing and the second bearing, and wherein the recess overlaps the first bearing and the second bearing in the radial direction between the first bearing and the second bearing In order to achieve the aspects and other advantages of the present invention, there is provided a scroll compressor, including a first scroll provided with a fixed disk portion and a fixed wrap formed on a first surface of the fixed disk portion, a second scroll provided with an orbiting disk portion, an orbiting wrap formed on a first surface of the orbiting disk portion and engaged with the fixed wrap to form compression chambers, and a boss portion protruding from a second surface of the orbiting disk portion, a rotating shaft provided with an eccentric portion inserted into the boss portion of the second scroll to transfer a rotational force, a frame having a shaft hole through which the rotating shaft is inserted, and supporting the second scroll in an axial direction, a first bearing provided between the shaft hole of the frame and an outer circumferential surface of the rotating shaft, and a second bearing provided between an inner circumferential surface of the boss portion and an outer circumferential surface of the eccentric portion of the rotating shaft, wherein a differential pressure space portion is formed between the first bearing and the second bearing in a radial direction, and has a radial cross section wider than a radial gap between an inner circumferential surface of the second bearing and the outer circumferential surface of the eccentric portion.

Here, the differential pressure space portion may be formed at an outer side of the eccentric portion in the radial direction.

The differential pressure space portion may be formed in a groove shape having a predetermined depth from an upper surface of the rotating shaft.

An outer circumferential surface of the boss portion may form an inner circumferential surface of the differential pressure space portion.

The scroll compressor may further include a bearing portion formed at an outer side of the differential pressure space portion to form an outer circumferential surface of the differential pressure space portion. The bearing portion may be eccentric with respect to the eccentric portion, and radially overlap the eccentric portion.

The bearing portion may be formed to have a different thickness along a circumferential direction, and the thickness of the bearing portion may be increasing away from the eccentric portion.

Here, a first gap may be formed between the second bearing and a member facing the second bearing, a second gap may be formed between an end surface of the boss portion and a bottom surface of the differential pressure space portion, and the second gap may be greater than or equal to the first gap.

An oil passage may be formed through an inside of the eccentric portion. An oil guide groove may be provided on at least one of an upper end and an outer circumferential surface of the eccentric portion. The oil guide groove may communicate with the oil passage to guide oil to pass through the first gap.

Here, the first bearing and the second bearing may at least partially overlap each other in the radial direction, and the differential pressure space portion may be formed between the first bearing and the second bearing.

The differential pressure space portion may be formed in an annular shape so as to surround an entire outer circumferential surface of the boss portion.

Here, the differential pressure space portion may be formed to be eccentric with respect to the eccentric portion.

In order to achieve the aspects and other advantages of the present invention, there is provided a scroll compressor, including a first scroll provided with a fixed disk portion and a fixed wrap formed on a first surface of the fixed disk portion, a second scroll provided with an orbiting disk portion, an orbiting wrap formed on a first surface of the orbiting disk portion and engaged with the fixed wrap to form compression chambers, and a boss portion protruding from a second surface of the orbiting disk portion, a rotating shaft inserted into the boss portion and having an eccentric portion protruding therefrom to transfer a rotational force to the second scroll, a frame having a shaft hole through which the rotating shaft is inserted, and supporting the second scroll in an axial direction, a first bearing provided between the shaft hole of the frame and an outer circumferential surface of the rotating shaft, and a second bearing provided between an inner circumferential surface of the boss portion and an outer circumferential surface of an eccentric portion of the rotating shaft, the second bearing at least partially overlapping the first bearing in a radial direction.

Here, a center of the first bearing and a center of the second bearing may be eccentric with respect to each other.

A differential pressure space portion may be provided between the first bearing and the second bearing, in a manner of having a predetermined depth at a height lower than an upper end of the second bearing.

The depth of the differential pressure space portion may be shorter than an axial length of the first bearing.

In a scroll compressor according to the present invention, a first bearing provided between a main frame and a rotating shaft and a second bearing provided between an orbiting scroll and the rotating shaft may be disposed to overlap each other in a radial direction and also a differential pressure space portion may be formed between the first bearing and the second bearing, so that oil sucked up along an oil passage can be quickly and smoothly supplied to the second bearing between the orbiting scroll and the rotating shaft by differential pressure.

Also, since the oil sucked up through the oil passage is quickly and smoothly supplied toward the second bearing, a frictional loss between the second bearing and the rotating shaft can be effectively suppressed.

In addition, since the oil supplied to the second bearing can rapidly pass through the second bearing and flow into the differential pressure space portion, heat generated in the second bearing can be quickly cooled so that the second bearing can be protected from damage. This may result in expanding a lifespan of the bearing and enhancing reliability.

DETAILED DESCRIPTION OF THE INVENTION

Description will now be given in detail of a scroll compressor according to exemplary embodiments disclosed herein, with reference to the accompanying drawings.

Figure 1:
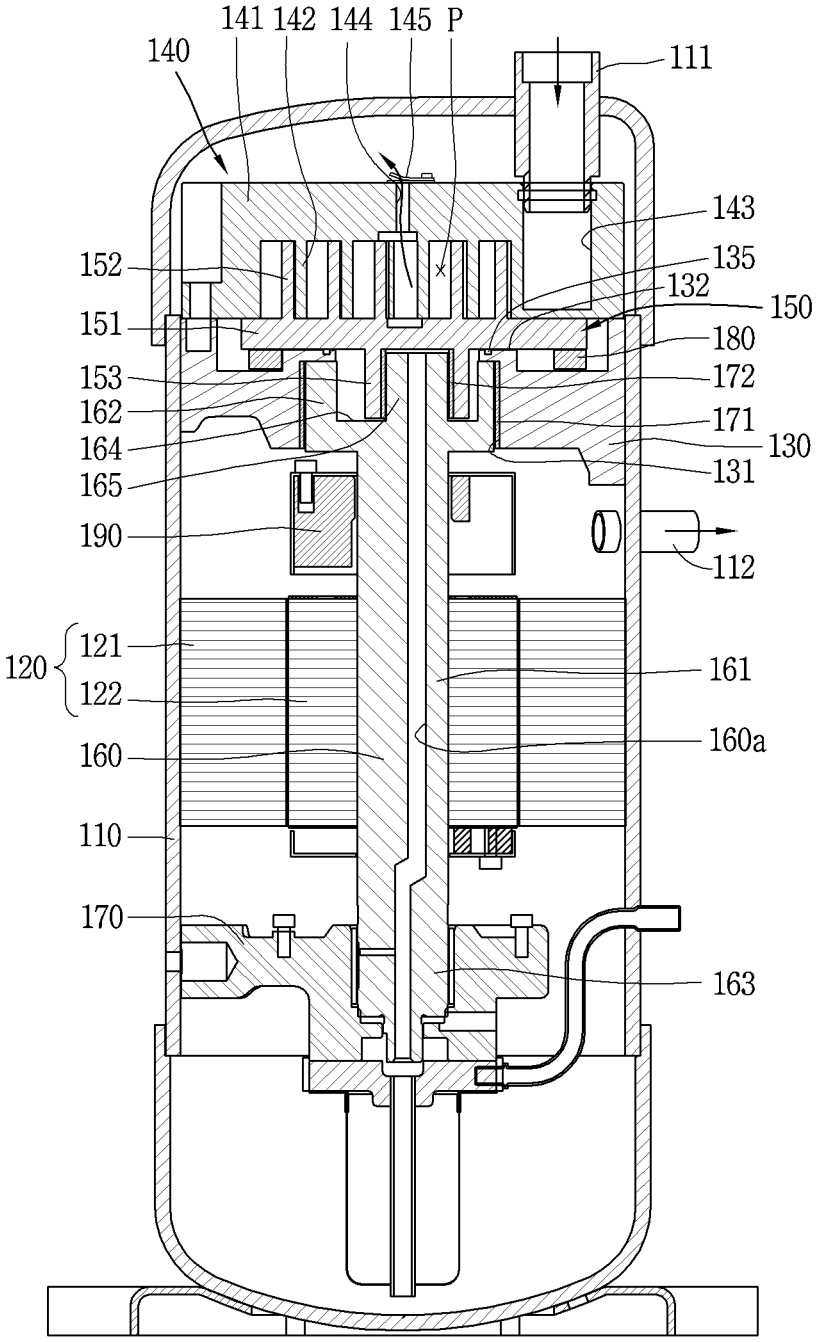
FIG. 1 is a sectional view illustrating an inside of a scroll compressor in accordance with the present invention.
Figure 2:
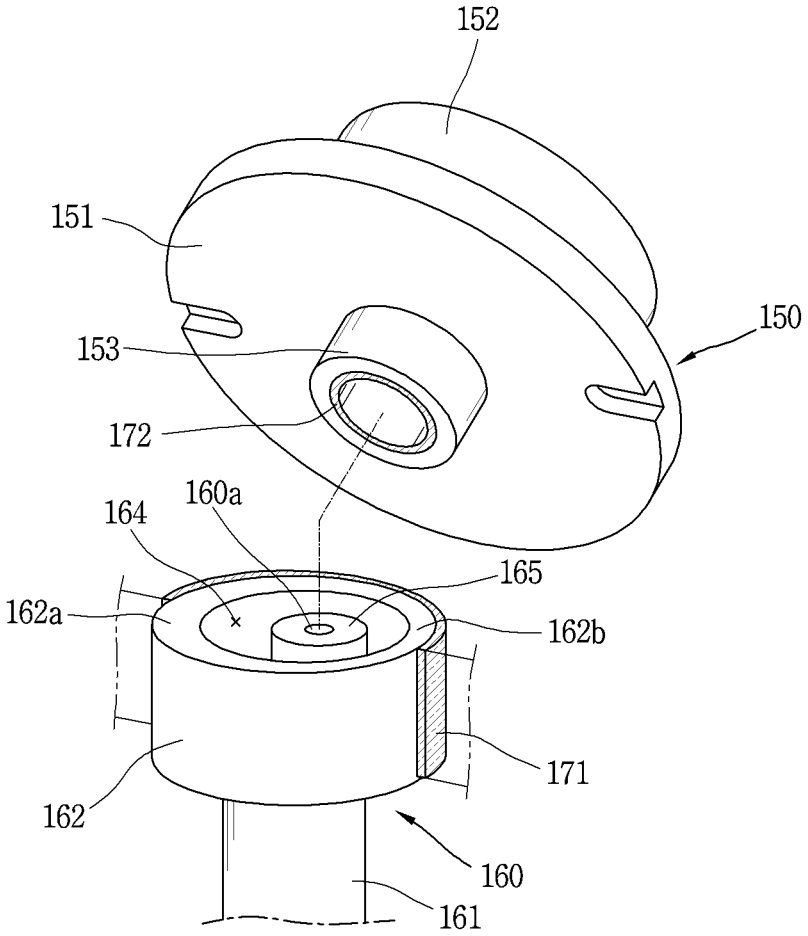
FIG. 2 is a perspective view illustrating an orbiting scroll, separated from a rotating shaft, in the scroll compressor according to FIG. 1.
Figure 3:
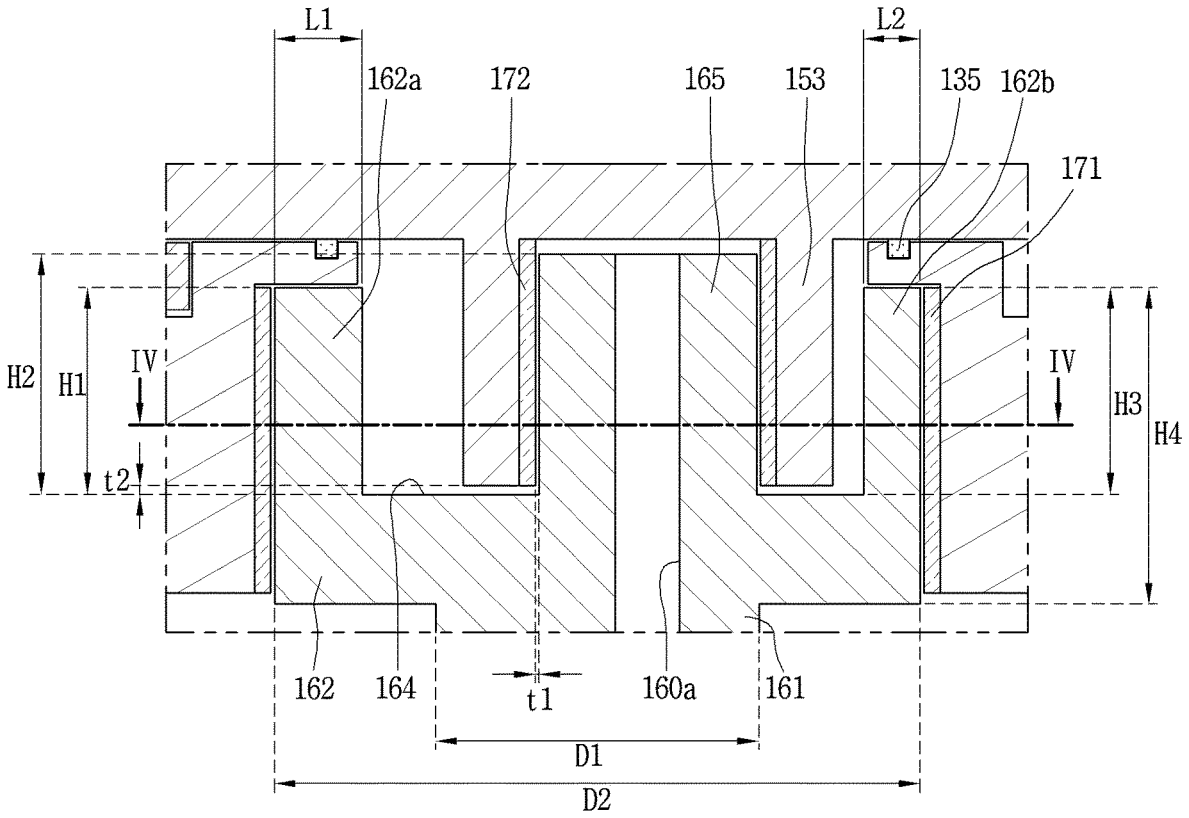
FIG. 3 is an enlarged sectional view of a differential pressure space portion in the scroll compressor according to FIG. 1.
Figure 4:
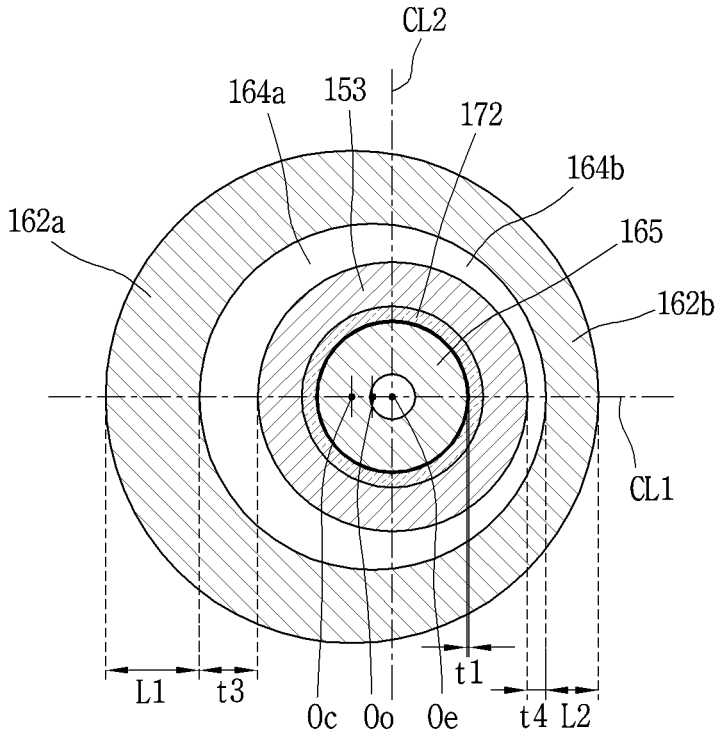
FIG. 4 is a sectional view taken along the line "IV-IV" of FIG. 3.

FIG. 1 is a sectional view illustrating an inside of a scroll compressor in accordance with the present invention, FIG. 2 is a perspective view illustrating an orbiting scroll, separated from a rotating shaft, in the scroll compressor according to FIG. 1, FIG. 3 is an enlarged sectional view of a differential pressure space portion in the scroll compressor according to FIG. 1, and FIG. 4 is a sectional view taken along the line "IV-IV" of FIG. 3.

As illustrated in those drawings, a scroll compressor according to an embodiment of the present invention may include a driving motor 120 disposed at an inner space of a casing 110 for generating a rotational force, and a main frame 130 fixed to an upper side of the driving motor 120. A fixed scroll (hereinafter, referred to as a first scroll) 140 may be fixed to an upper surface of the main frame 130 and an orbiting scroll (hereinafter, referred to as a second scroll) 150 may be provided between the main frame 130 and the first scroll 140. The second scroll 150 may be coupled eccentrically to a rotating shaft 160 coupled to a rotor 122 of the driving motor 120, and an Oldham ring 180 for preventing rotation of the second scroll 150 may be provided between the first scroll 140 and the second scroll 150. Accordingly, the second scroll 150 forms a pair of two compression chambers P, which continuously move, together with the first scroll 140 while performing an orbiting motion with respect to the first scroll 140.

The main frame 130 may be welded onto an inner circumferential surface of the casing 110, and a shaft hole 131 may be formed through a center of the main frame 130. The shaft hole 131 may have the same diameter from upper to lower ends thereof.

A first radial bearing (hereinafter, referred to as a first bearing) 171 for supporting the rotating shaft 160 in a radial direction may be press-fitted to an inner circumferential surface of the shaft hole 131 and the rotating shaft 160 may be rotatably inserted into the first bearing 171. The first bearing 171 may be configured as a bush bearing.

The first scroll 140 is provided with a disk portion (fixed disk portion) 141 formed in a shape of a disk, and the fixed disk portion 141 is coupled to the main frame 130 and supported in an axial direction. A fixed wrap 142 may be formed on a lower surface of the fixed disk portion 141 and a suction port 143 through which a suction pipe 111 and a compression chamber P communicate with each other may be formed at an edge of the fixed disk portion 141. A discharge port 144 through which a refrigerant compressed in the compression chamber P is discharged into the inner space of the casing 110 may be formed at a center of the fixed disk portion 141. Accordingly, a check valve 145 may be provided to open the discharge port 144 when the compressor performs a normal operation and close the discharge port 144 when the compressor is stopped, so as to prevent a refrigerant discharged into the inner space of the casing 110 from flowing back into the compression chamber P through the discharge port 144.

The second scroll 150 is provided with a disk portion (orbiting disk portion) formed in a shape of a disk. The orbiting disk portion 151 is axially supported by the main frame 130 and located between the main frame 130 and the first scroll 140. On a first surface, which is an upper surface of the orbiting disk portion 151, an orbiting wrap 152 which is engaged with the fixed wrap 142 to form the pair of compression chambers P is formed.

A boss portion 153 into which an eccentric portion 165 of the rotating shaft 160 to be explained later is inserted is formed on a second surface as a lower surface of the orbiting disk portion 151 in a manner of protruding by a predetermined height. Accordingly, the second scroll 150 is coupled to the rotor 122 of the driving motor 120 by the rotating shaft 160 and receives the rotational force of the driving motor 120.

The boss portion 153 may be formed at a geometric center of the second scroll 150. The boss portion 153 may be formed in a hollow cylindrical shape, and a second radial bearing (hereinafter, referred to as a second bearing) 172, which supports the eccentric portion 165 of the rotating shaft 160 in the radial direction, may be press-fitted to an inner circumferential surface of the boss portion 153. The second bearing 172 may be configured as a bush bearing and an inner circumferential surface of the second bearing 172 and an outer circumferential surface of the eccentric portion 165 may be spaced apart from each other by a first gap t1.

The boss portion 153 protrudes toward the main frame 130 by a predetermined height, and may be formed in a manner that a lower end of the boss portion 153 is spaced apart by a second gap t2 from a bottom surface of a differential pressure space portion 164 to be explained later. The second gap t2 may be greater than or equal to the first gap t1. However, the second gap t2 may preferably be formed to be greater than the first gap t1 in that resistance can be reduced when oil sucked upward through an oil passage 160*a* of the rotating shaft 160 to be explained later moves to the differential pressure space portion 164 via the first gap t1 and the second gap t2.

The rotating shaft 160 may include a shaft portion 161, a plurality of bearing portions 162 and 163 provided at both upper and lower sides of the shaft portion 161, a differential pressure space portion 164 recessed by a predetermined depth from an upper surface of the main bearing portion 162 coupled to the first bearing 171 of the plurality of bearing portions 162 and 163, and an eccentric portion 165 protruding from the differential pressure space portion 164 to be coupled to the boss portion 153 of the second scroll 150. Accordingly, the main bearing portion 162 and the eccentric portion 165 may be formed to partially overlap each other in the radial direction.

The shaft portion 161 is press-fitted into the rotor 122 of the drive motor 120 and the main bearing portion 162 is rotatably inserted into the first bearing 171 to be radially supported by the main frame 130. An outer diameter D2 of the main bearing portion 162 may be greater than an outer diameter D1 of the shaft portion 161. Accordingly, an outer diameter of the main frame 130 may also be increased. However, the size of the main frame 130 may not be increased if the main bearing portion 162 is formed as great as possible within a range where it does not interfere with the Oldham ring 180 in the radial direction.

The eccentric portion 165 may be formed to be eccentric from a center Oc of the shaft portion 161. Accordingly, an empty space is formed at one side of the eccentric portion 165 in an upper end of the rotating shaft 160, and the differential pressure space portion 164 may be formed by using the empty space.

As described above, the eccentric portion 165 may overlap the main bearing portion 162 in the radial direction, and may be formed at the same height as the main bearing portion 162. However, the eccentric portion 165 may be formed to be higher than the main bearing portion 162 so as to stably transmit the rotational force to the second scroll 150. That is, the height of the eccentric portion 153 may be made as high as possible so that an area where the eccentric portion 165 and the boss portion 153 are coupled to each other can be widened.

In this case, with respect to a bottom surface of the differential pressure space portion 164, a height H2 of the eccentric portion 165 may be higher than a height H1 of the main bearing portion 162, and thus a thrust portion 132 may be formed by inwardly extending from an upper end of the shaft hole 131 of the main frame 130 to be located more inward than the first bearing 171. A sealing member 135 which is formed in an annular shape may be provided on an upper surface of the thrust portion 132 so as to prevent oil flowing into the differential pressure space portion 164 from being excessively introduced between the main frame 130 and the second scroll 150. Accordingly, even if the diameter of the main bearing portion 162 is enlarged, a diameter of the sealing member 135 can be prevented from increasing, which may result in reducing an increase in a material cost and a frictional loss due to the sealing member 135.

When a center Oe of the eccentric portion 165 is not excessively eccentric from the center Oc of the rotating shaft 160, the outer diameter of the main bearing portion 162 may not be excessively increased as compared with those prior arts (specifically, Prior Art 2). However, in this case, in order to secure a volume of the compression chamber P, an orbiting radius of the second scroll 150 may be reduced and heights of the fixed wrap 142 and the orbiting wrap 152 may be increased. In this case, the first scroll 140 and the second scroll 150 are preferably formed of a material whose strength is ensured, in order to secure reliability as the height of each of the wraps 142 and 152 increases.

On the other hand, the height H1 of the main bearing portion 162 may be lower than the height H2 of the eccentric portion 165, with reference to the bottom surface of the differential pressure space portion 164. In particular, when the main bearing portion 162 is formed at a position where it may interfere with the Oldham ring 180 in the radial direction, the height H1 of the main bearing portion 162 may preferably be formed to be lower than the height H2 of the eccentric portion 165, which may result in avoiding the interference between the Oldham ring 180 and the main bearing portion 162. This will be described again later.

Here, since the eccentric portion 165 is formed eccentrically inside the main bearing portion 162, the differential pressure space portion 164 described above is formed between an inner circumferential surface of the main bearing portion 162 and an outer circumferential surface of the eccentric portion 165. Since the boss portion 153 of the second scroll 150 is positioned in the differential pressure space portion 164, the differential pressure space portion 164 may be substantially formed between the inner circumferential surface of the main bearing portion 162 and the outer circumferential surface of the boss portion 153 of the second scroll 150.

Furthermore, the main bearing portion may alternatively be formed to have a different thickness along a circumferential direction. For example, as illustrated in FIGS. 3 and 4, the main bearing portion 162 may be formed in an annular shape surrounding the differential pressure space portion 164. In this case, the main bearing portion 162 may be formed in a manner that both sides thereof are symmetric with each other with respect to a first center line CL1 to be explained later, and asymmetric with each other with respect to a second center line CL2 to be explained later. Accordingly, with respect to the second center line CL2, the main bearing portion 162 may be provided with a first main bearing part 162*a* having a large area at a side where a center Oo of the differential pressure space portion is located, and a second main bearing part 162*b* having a narrow area at an opposite side.

A thickness L1 of the first main bearing part 162*a* may be larger than a thickness L2 of the second main bearing part 162*b*. That is, a central portion of the first main bearing part 162*a* (a portion through which the first center line passes) is the thickest, and the thickness may be gradually decreased toward both sides from the central portion.

As such, since the thickness of the first main bearing part 162*a* located away from the eccentric portion 165 is relatively larger than the thickness of the second main bearing part 162*b* near the eccentric portion 165, stress applied to the main bearing portion 162 during the rotation of the rotating shaft can be reduced. In addition, since the main bearing portion 162 serves as a kind of eccentric mass, an eccentric load of the driving motor 120 can be reduced while reducing a weight of an eccentric mass 190 coupled to the rotating shaft 160.

However, the thickness of the main bearing portion 162 may alternatively be uniform along the circumferential direction. In this case, an area of a first differential pressure space part 164*a* to be described later may be widened so as to increase a pressure difference between the oil passage 160*a* and the differential pressure space portion 164, and accordingly oil sucked upward along the oil passage 160*a* can flow smoothly toward the differential pressure space portion 164, thereby lubricating and cooling the first bearing 171 more quickly.

On the other hand, the differential pressure space portion 164, as illustrated in FIG. 4, may be formed in the annular shape surrounding the eccentric portion 165. In this case, the center Oo of the differential pressure space portion 164 may be eccentric from the center Oe of the eccentric portion by an orbiting radius, so as to substantially coincide with the center Oc of the rotating shaft with each other. Accordingly, oil contained in the differential pressure space portion 164 generates a centrifugal force when the rotating shaft 160 rotates, and this centrifugal force generates a kind of suction force of forcing oil sucked up through the oil passage 160*a* to be introduced into the differential pressure space portion 164. Also, this oil may quickly flow to a thrust surface between the main frame 130 and the second scroll 150 by the centrifugal force.

The differential pressure space portion 164 may be formed in such a manner that both sides with respect to the first center line CL1 passing through the center Oo of the differential pressure space portion and the center Oe of the eccentric portion are symmetric with each other and both sides with respect to the second center line CL2 which is perpendicular to the first center line CL1 and passes through the center Oe of the eccentric portion are asymmetrical with each other. In this case, with respect to the second center line CL2, the differential pressure space portion 164 may be provided with a first differential pressure space part 164*a* having a large area at a side where the center Oo of the differential pressure space portion is located, and a second differential pressure space part 164*b* having a narrow area at an opposite side.

Accordingly, a maximum gap t3 between an inner circumferential surface of the first differential pressure space part 164*a* and an outer circumferential surface of the boss portion 153 may be greater than a minimum gap t4 between an inner circumferential surface of the second differential pressure space part 164*b* and the outer circumferential surface of the boss portion 153.

Here, the minimum gap t4 of the second differential pressure space part 164*b* may be formed to be greater than zero (0). If the minimum gap t4 becomes zero and accordingly the inner circumferential surface of the second differential pressure space part 164*b* comes into contact with the outer circumferential surface of the boss portion 153, the eccentric portion 165 performs a relative motion with respect to the boss portion 153 during the rotation of the rotating shaft 160. Due to the relative motion, friction is caused between the outer circumferential surface of the eccentric portion 165 and the inner circumferential surface of the boss portion 153. Accordingly, the minimum gap t4 of the second differential pressure space part 164*b* may be preferably formed to be at least zero or greater.

The differential pressure space portion 164 may be formed to have a depth H3 which is deep enough that the second gap t2 can be secured to be equal to or greater than the first gap t1. Accordingly, the oil sucked up through the oil passage 160*a* of the rotating shaft 160 can smoothly pass through the second bearing 172 and move to the differential pressure space portion 164.

Also, as an axial length H4 of the main bearing portion 162 (or an axial length of the first bearing) constituting an outer wall of the differential pressure space portion 164 is greater than the depth H3 of the differential pressure space portion 164 forming a groove, a bearing surface can be secured, which may minimize reduction of rigidity of the main bearing portion 162, thereby enhancing reliability.

In the drawings, unexplained reference numeral 112 denotes a discharge pipe, and 121 denotes a stator.

The scroll compressor according to this embodiment may provide the following operation effects.

That is, when power is applied to the driving motor 120 to generate a rotational force, the orbiting scroll 150 eccentrically coupled to the rotating shaft 160 performs an orbiting motion. During the orbiting motion, a pair of compression chambers P which continuously move are formed between the orbiting scroll 150 and the fixed scroll 140.

Then, the compression chambers P gradually become smaller in volume as they move from a suction port (or suction chamber) 143 to a discharge port (or discharge chamber) 144 while the orbiting scroll is performing the orbiting motion.

A refrigerant supplied from outside of the casing 110 then flows through the suction port 143 of the fixed scroll 140 via the suction pipe 111. This refrigerant is compressed while being moved toward a final compression chamber by the orbiting scroll 150. The compressed refrigerant is discharged from the final compression chamber into the inner space of the casing 110 through the discharge port 144 of the fixed scroll 140. This series of processes is repeatedly performed.

Here, the main bearing portion 162 which is supported by the main frame 130 in the radial direction is formed at an upper end part of the rotation shaft 160. The eccentric portion 165 coupled to the second scroll 150 as the orbiting scroll is formed inside the main bearing portion 162, and the main bearing portion 162 and the eccentric portion 165 are formed to overlap each other in the radial direction.

This may result in removing or minimizing a height difference Δh in the axial direction between a support point A at which the rotating shaft 160 is supported by the main frame 130 and a point of application B at which the rotating shaft 160 acts on the second scroll 150. As a result, an eccentric load applied to the rotating shaft 160 can be reduced and thus a frictional loss at the main bearing portion 162 can be reduced, thereby improving compression efficiency of the compressor. In addition, an action force at a welding point between the casing 110 and the main frame 130 can be lowered, thereby reducing compressor noise and improving reliability.

Also, the weight of the eccentric mass 190 coupled to the rotating shaft 160 and the material costs can be reduced by reducing the eccentric load applied to the rotating shaft 160. In addition, deformation of the rotating shaft 160 can be reduced by reducing the eccentric load applied to the rotating shaft 160, which may result in enhancing compression efficiency. Further, as the weight of the eccentric mass 190 is reduced, the action force at the welding point between the casing 110 and the main frame 130, which is generated due to the centrifugal force of the eccentric mass 190, can also be reduced. This may result in reducing compressor noise and improving reliability.

In addition, since a separate pocket groove for storing oil is not required in the main frame 130, the axial length and diameter of the main frame 130 can be reduced. This may result in reducing material costs and simultaneously reducing a size of the compressor relative to the same capacity. In addition, a stacked height of the driving motor 120 relative to an axial length of the same casing 110 can be increased so as to improve compressor performance.

On the other hand, in the case of eliminating or minimizing the axial height difference between the support point at which the rotating shaft is supported by the main frame and the point of application at which the rotating shaft acts on the second scroll as described above, the first bearing and the second bearing are formed at a height where at least parts thereof overlap each other in the radial direction. Accordingly, the first bearing is located outside the boss portion of the second scroll. Therefore, since a great pressure difference is not generated between both sides of the second bearing, the oil taken up through the oil passage of the rotating shaft may fail to smoothly pass through the second bearing. In this case, an oil supply to the second bearing is not smoothly carried out, which may cause a frictional loss. Also, frictional heat generated at the second bearing is not quickly cooled, which may damage the second bearing.

Figure 5:
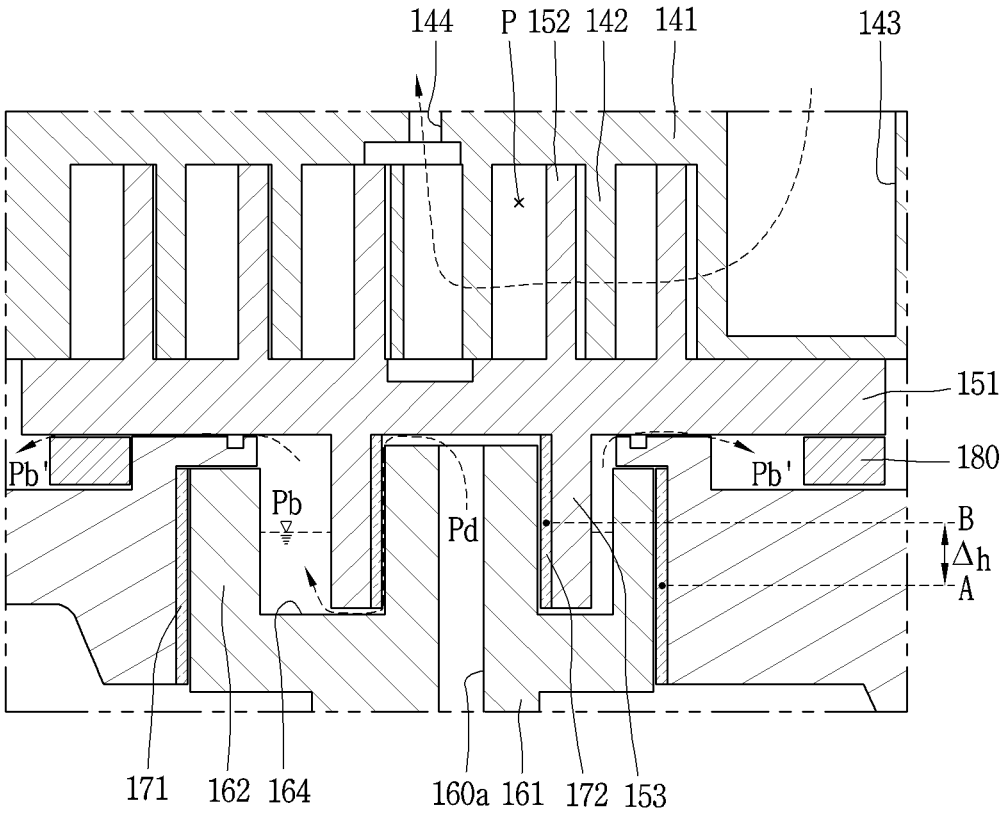
FIG. 5 is a sectional view illustrating a state in which oil flows to a differential pressure space portion via a second bearing during an operation of a compressor in a scroll compressor according to the present invention.

Thus, in this embodiment, the differential pressure space portion having the predetermined area is formed between the first bearing and the second bearing, so that oil sucked up through the oil passage can be quickly and smoothly supplied to the second bearing and then discharged through the second bearing. FIG. 5 is a sectional view illustrating a state in which oil flows to a differential pressure space portion via a second bearing during an operation of a compressor in the scroll compressor according to the present invention.

As illustrated in FIG. 5, the differential pressure space portion 164 is formed on an upper end surface of the rotating shaft 160. The differential pressure space portion 164 communicates with the oil passage 160*a* of the rotating shaft 160 between the boss portion 153 of the second scroll 150 and the eccentric portion 165 of the rotating shaft 150, more accurately, between the inner circumferential surface of the second bearing provided on the inner circumferential surface of the boss portion 153 and the outer circumferential surface of the eccentric portion 165. The second gap t2 between the lower end of the boss portion 153 and the bottom surface of the differential pressure space portion 164 is greater than or at least equal to the first gap t1 between the inner circumferential surface of the second bearing 172 and the outer circumferential surface of the eccentric portion 165.

Here, the oil passage 160*a* of the rotating shaft 160 forms substantially discharge pressure Pd, while the differential pressure space portion 164 forms substantially intermediate pressure Pb. This allows the oil to quickly flow from the oil passage 160*a* of the rotating shaft 160 forming the discharge pressure Pd toward the differential pressure space portion 164 forming the intermediate pressure Pb.

At this time, the second gap t2 between the lower end of the boss portion 153 and the bottom surface of the differential pressure space portion 164 is greater than or equal to the first gap between the inner circumferential surface of the second bearing 172 and the outer circumferential surface of the eccentric portion 165, which allows the oil to move toward the differential pressure space portion 164 more quickly. During this process, the oil can lubricate between the inner circumferential surface of the second bearing 172 and the outer circumferential surface of the eccentric portion 165, thereby effectively suppressing a frictional loss between the second bearing and the eccentric portion.

In addition, since the oil quickly flows along between the inner circumferential surface of the second bearing 172 and the outer circumferential surface of the eccentric portion 165, the oil of relatively low temperature can transfer frictional heat generated in the second bearing 172 to the differential pressure space portion 164, thereby cooling the second bearing 172. This may result in effectively preventing the second bearing 172 from being overheated.

On the other hand, the oil that has moved to the differential pressure space portion 164 flows to a back pressure space along the thrust surface due to the centrifugal force generated while the rotating shaft 160 rotates and a pressure difference between the differential pressure space portion and an intermediate pressure space. That is, an intermediate pressure space, which is a space formed by the main frame 130, the first scroll 140, and the second scroll 150, communicates with the differential pressure space portion 164 through the thrust surface between the main frame 130 and the second scroll 150. Pressure in the intermediate pressure space is intermediate pressure Pb' which is higher than suction pressure but lower than the pressure Pb in the differential pressure space portion. Therefore, the oil taken up through the oil passage 160*a* of the rotating shaft 160 flows along between the second bearing 172 and the eccentric portion 165 to be introduced into the differential pressure space portion 164 and then moves to the intermediate pressure space over the sealing member 135. Accordingly, the pressure of the differential pressure space portion 164 is lower than pressure of the inner space of the casing 110, and thus the oil flows along the passage continuously. Although not shown, a differential pressure hole may be formed on the disk portion of the second scroll, so that the oil in the differential pressure space portion can flow into a suction chamber forming suction pressure therethrough.

Hereinafter, description will be given of another embodiment of an eccentric portion in the scroll compressor according to the present invention.

That is, in the foregoing embodiment, an upper end and outer circumferential surface of the eccentric portion is formed flat and plain. However, in another embodiment, an oil guide groove communicating with the oil passage may be formed on the upper end or outer circumferential surface of the eccentric portion.

Figure 6:
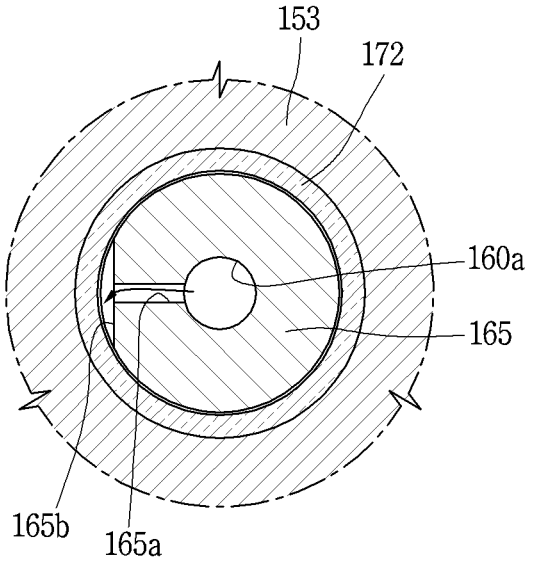
FIG. 6 is a planar view illustrating an example in which an oil guide groove is formed at an eccentric portion in a scroll compressor according to the present invention.

For example, as illustrated in FIG. 6, a first oil guide groove 165*a* and a second oil guide groove 165*b* along which the oil sucked up through the oil passage 160*a* can smoothly flow to the differential pressure space portion 164 may be consecutively formed on the upper end and the outer circumferential surfaces of the eccentric portion 153.

The first oil guide groove 165*a* may be formed to have a predetermined depth, while the second oil guide groove 165*b* may be formed in a D-cut shape. However, the first oil guide groove 165*a* may not be formed when a sufficient space is provided between the upper end of the eccentric portion 165 and an upper surface of the boss portion 153.

Hereinafter, description will be given of another embodiment of a main bearing portion in the scroll compressor according to the present invention.

That is, in the foregoing embodiment, the main bearing portion is formed so as not to interfere with the Oldham ring in the radial direction. However, in another embodiment, the main bearing portion may be formed to have a large outer diameter so as to interfere with the Oldham ring in the radial direction.

Figure 7:
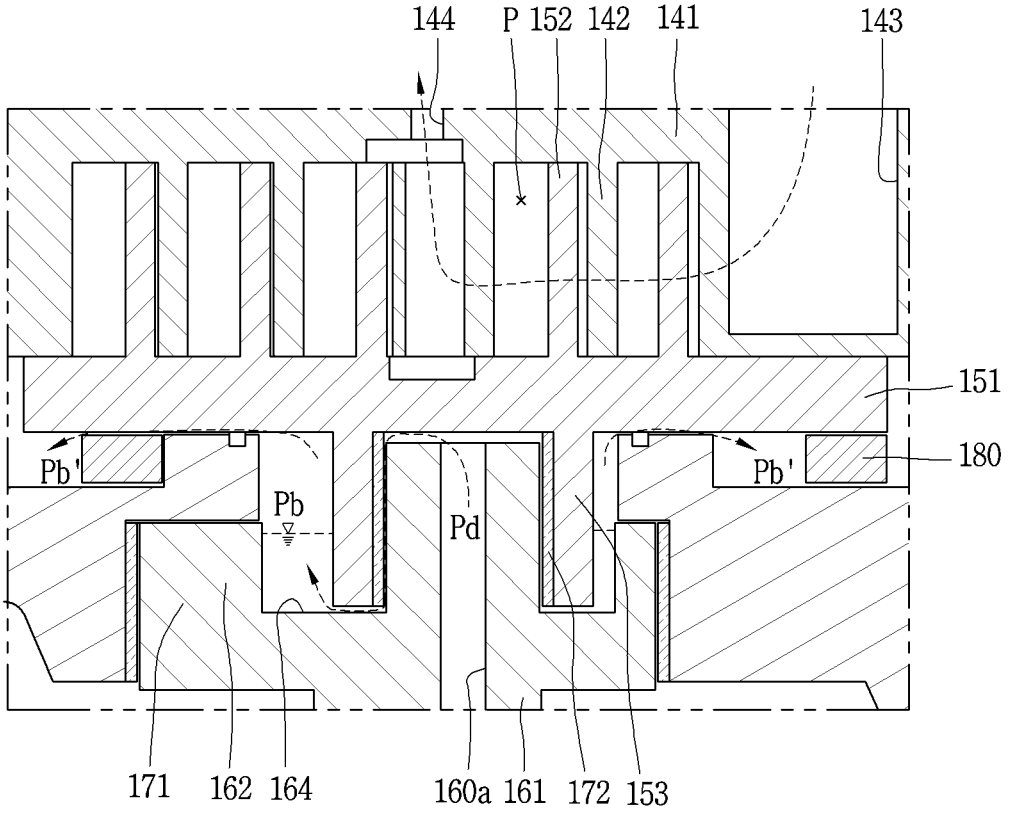
FIG. 7 is a sectional view illustrating another embodiment related to a position of a main bearing portion according to a size of a differential pressure space portion in a scroll compressor according to the present invention.

In this case, as illustrated in FIG. 7, the main bearing portion 162 may be formed to be lower than the Oldham ring 180 in height, so that the main bearing portion 162 and the Oldham ring 180 do not interfere with each other in the radial direction. Alternatively, although not illustrated, an outer circumferential surface of an upper end of the main bearing portion 162 may be formed to be stepped so as to avoid interference with the Oldham ring 180 in the radial direction.

As such, when the outer diameter of the main bearing portion 162 is formed to be large so that the main bearing portion 162 can interfere with the Oldham ring 180 in the radial direction but actually the main bearing portion 162 is formed low in height so as not to interfere with the Oldham ring 180, the wide differential pressure space portion as well as a wide thickness of the main bearing portion 162 can be secured.

What is claimed is:

1. A scroll compressor, comprising:

a first scroll comprising a fixed disk portion and a fixed wrap disposed at a surface of the fixed disk portion;

a second scroll comprising an orbiting disk portion, an orbiting wrap that extends in an axial direction from a first surface of the orbiting disk portion toward the first scroll and that defines, based on engaging with the fixed wrap, compression chambers between the orbiting wrap and the fixed wrap, and a boss portion that protrudes from a second surface of the orbiting disk portion;

a rotating shaft comprising an eccentric portion that is inserted to the boss portion of the second scroll and that is configured to transfer a rotational force to the second scroll;

a frame that supports the second scroll in the axial direction and that defines a shaft hole that receives the rotating shaft;

a first bearing disposed between an outer circumferential surface of the rotating shaft and an inner surface of the frame that defines the shaft hole; and a second bearing disposed between an inner circumferential surface of the boss portion and an outer circumferential surface of the eccentric portion of the rotating shaft, wherein the first bearing and the second bearing are spaced apart from each other in a radial direction, wherein the rotating shaft and the boss portion define a differential pressure space portion radially between the first bearing and the second bearing, and wherein a width of the differential pressure space portion in the radial direction is greater than a radial gap between an inner circumferential surface of the second bearing and the outer circumferential surface of the eccentric portion.

2. The scroll compressor of claim 1, wherein the differential pressure space portion is disposed outward of the eccentric portion in the radial direction.

3. The scroll compressor of claim 1, wherein the rotating shaft defines a groove that is recessed from an upper surface of the rotating shaft by a predetermined depth and that is configured to receive the boss portion, and wherein the groove of the rotating shaft defines the differential pressure space portion.

4. The scroll compressor of claim 1, wherein an outer circumferential surface of the boss portion faces an inner circumferential side of the differential pressure space portion.

5. The scroll compressor of claim 1, further comprising a bearing portion that is disposed radially outward of the differential pressure space portion and that faces an outer circumferential side of the differential pressure space portion, wherein the bearing portion extends in the axial direction, surrounds the eccentric portion, and is eccentric with respect to a center of the eccentric portion.

6. The scroll compressor of claim 5, wherein a radial thickness of the bearing portion varies along a circumferential direction, and wherein the radial thickness of the bearing portion increases based on an increase of a distance between the eccentric portion and the bearing portion.

7. The scroll compressor of claim 1, wherein the boss portion defines an axial gap between a lower end of the boss portion and a bottom surface of the differential pressure space portion, and wherein the axial gap is greater than or equal to the radial gap.

8. The scroll compressor of claim 7, wherein the eccentric portion defines an oil passage that penetrates an inside of the eccentric portion, and wherein at least one of an upper end of the eccentric portion or the outer circumferential surface of the eccentric portion defines an oil guide portion that is in communication with the oil passage and that is configured to guide oil from the oil passage to the radial gap.

9. The scroll compressor of claim 1, wherein the first bearing overlaps at least a portion of the second bearing in the axial direction, and wherein the differential pressure space portion is defined between the first bearing and the second bearing, and overlaps at least a part of the first bearing or the second bearing in the axial direction.

10. The scroll compressor of claim 9, wherein the differential pressure space portion has an annular shape that surrounds an entire portion of an outer circumferential surface of the boss portion.

11. The scroll compressor of claim 10, wherein the differential pressure space portion is eccentric with respect to a center of the eccentric portion.

12. A scroll compressor, comprising:

a first scroll comprising a fixed disk portion and a fixed wrap disposed at a surface of the fixed disk portion;

a second scroll comprising an orbiting disk portion, an orbiting wrap that is disposed a first surface of the orbiting disk portion and that defines compression chambers based on engaging with the fixed wrap, and a boss portion that protrudes from a second surface of the orbiting disk portion;

a rotating shaft that is inserted into the boss portion, the rotating shaft comprising an eccentric portion that protrudes toward the second scroll and that is configured to transfer a rotational force to the second scroll;

a frame that supports the second scroll in an axial direction and that defines a shaft hole that receives the rotating shaft;

a first bearing disposed between an outer circumferential surface of the rotating shaft and an inner surface of the frame that defines the shaft hole; and a second bearing disposed between an inner circumferential surface of the boss portion and an outer circumferential surface of the eccentric portion of the rotating shaft, wherein the second bearing overlaps at least a portion of the first bearing in an axial direction.

13. The scroll compressor of claim 12, wherein a center of the first bearing is offset from a center of the second bearing.

14. The scroll compressor of claim 13, wherein the boss portion and the rotating shaft define a differential pressure space portion radially between the first bearing and the second bearing, and wherein the differential pressure space portion is recessed by a predetermined depth from an upper end of the rotating shaft, the upper end of the rotating shaft being vertically below an upper end of the second bearing.

15. The scroll compressor of claim 14, wherein the predetermined depth of the differential pressure space portion is less than an axial length of the first bearing.

16. The scroll compressor of claim 14, wherein the boss portion defines an axial gap between a lower end surface of the boss portion and a bottom surface of the differential pressure space portion, and wherein the axial gap is greater than or equal to a radial gap defined between the second bearing and the outer circumferential surface of the eccentric portion.

17. The scroll compressor of claim 12, wherein the rotating shaft further comprises a bearing portion that extends from an upper portion of the rotating shaft in the axial direction toward the second scroll, that is spaced apart from the outer circumferential surface of the eccentric portion in a radial direction, and that surrounds at least a portion of the eccentric portion.

18. The scroll compressor of claim 17, wherein the first bearing is disposed at an outer circumferential surface of the bearing portion.

19. The scroll compressor of claim 18, wherein the first bearing has:

an outer circumferential surface that contacts the inner surface of the frame; and an inner circumferential surface that is spaced apart from the outer circumferential surface of the bearing portion in the radial direction.

20. The scroll compressor of claim 12, wherein the second bearing has:

an outer circumferential surface that contacts an inner circumferential surface of the boss portion; and an inner circumferential surface that is spaced apart from the outer circumferential surface of the eccentric portion.

* * * * *